US009926720B2

(12) United States Patent
Huang

(10) Patent No.: US 9,926,720 B2
(45) Date of Patent: Mar. 27, 2018

(54) ROOF RACK OF COLLAPSIBLE TENT AND COLLAPSIBLE TENT RACK

(71) Applicant: XIAMEN ROADZUP OUTDOOR PRODUCTS CO., LTD., Xiamen, Fujian (CN)

(72) Inventor: Changjiu Huang, Fujian (CN)

(73) Assignee: XIAMEN ROADZUP OUTDOOR PRODUCTS CO., LTD., Xiamen (CN)

( * ) Notice: Subject to any disclaimer, the term of this patent is extended or adjusted under 35 U.S.C. 154(b) by 0 days.

(21) Appl. No.: 15/250,228

(22) Filed: Aug. 29, 2016

(65) Prior Publication Data

US 2016/0369524 A1 Dec. 22, 2016

Related U.S. Application Data

(62) Division of application No. 14/795,417, filed on Jul. 9, 2015.

(30) Foreign Application Priority Data

Oct. 21, 2014 (CN) ..... 2014 2 0609256 U

(51) Int. Cl.

| | |
|---|---|
| ***E04H 15/60*** | (2006.01) |
| ***E04H 15/50*** | (2006.01) |
| ***E04H 15/32*** | (2006.01) |
| ***E04H 15/54*** | (2006.01) |

(52) U.S. Cl.

CPC ..... *E04H 15/50* (2013.01); *E04H 15/322* (2013.01); *E04H 15/54* (2013.01)

(58) Field of Classification Search

CPC ..... E04H 15/48; E04H 15/60

See application file for complete search history.

(56) References Cited

U.S. PATENT DOCUMENTS

| | | | | |
|---|---|---|---|---|
| 6,848,461 | B2 | 2/2005 | Tsai | |
| 7,367,348 | B2 | 5/2008 | Tsai et al. | |
| 8,544,489 | B2 | 10/2013 | Choi | |
| 8,616,226 | B2 | 12/2013 | Ma et al. | |
| 8,893,737 | B2 | 11/2014 | Yang | |
| 9,528,292 | B1 * | 12/2016 | Lovley, II | E04H 15/48 |
| 2002/0092555 | A1 * | 7/2002 | Chen | E04H 15/50 135/144 |
| 2007/0051397 | A1 | 3/2007 | Choi | |
| 2007/0186967 | A1 | 8/2007 | Zingerle | |
| 2015/0376913 | A1 | 12/2015 | Choi | |

FOREIGN PATENT DOCUMENTS

CN 104358468 A * 2/2015

* cited by examiner

*Primary Examiner* — Noah Chandler Hawk

(74) *Attorney, Agent, or Firm* — Rabin & Berdo, P.C.

(57) ABSTRACT

A roof rack of a collapsible tent includes a tent rack and roof poles. The tent rack includes stand columns, tent poles and support poles. The top end of the stand column is fixedly disposed with a top base, a slide base is slidably connected to the stand column to slide up and down along the stand column, the first end of the tent pole is pivoted joint to the top base, the first end of the stand column is pivoted joint to the slide base, the second end of the support pole is pivoted joint to the tent pole; the stand column, the slide base, the tent pole and the support pole form a linkage mechanism, the slide base slides up and down along the stand column to drive the tent rack to unfold and fold; the roof pole is movably connected to the linkage mechanism.

6 Claims, 13 Drawing Sheets

ROOF RACK OF COLLAPSIBLE TENT AND COLLAPSIBLE TENT RACK

CROSS-REFERENCE TO RELATED APPLICATION

This application is a divisional of co-pending application Ser. No. 14/795,417, filed Jul. 9, 2015, the entire disclosure of which is incorporated herein by reference.

FIELD OF THE INVENTION

The present invention relates to a roof rack of a collapsible tent and a collapsible tent rack.

BACKGROUND OF THE INVENTION

Existing collapsible tent rack has its roof rack comprising a tent rack and roof poles. The tent rack comprises stand columns, tent poles and support poles, the top end of the stand column is fixedly disposed with a top base, the stand column is slidably disposed with a slide base that can slide up and down along the stand column, the first end of the tent pole is pivoted joint to the top base, the first end of the support pole is pivoted joint to the slide base, the second end of the support pole is pivoted joint to the tent pole, the slide base slides up and down along the stand column to drive the tent rack to unfold and fold. The roof pole is slidably connected to the top base or the tent pole to realize the unfolding or folding of the roof pole. There are disadvantages in the existing collapsible tent rack: to unfold the tent rack, it needs to unfold the tent rack firstly, and then pulls the roof poles out, therefore, it needs two steps to unfold the tent rack, the folding process also needs two steps, thus it makes the unfolding and folding inconvenient.

SUMMARY OF THE INVENTION

The present invention provides a roof rack of a collapsible tent and a collapsible tent rack, which overcome the disadvantage of the exiting known technology.

One technical proposal of the present invention to solve the technical problem is that:

A roof rack of a collapsible tent, comprising a tent rack and roof poles, the tent rack comprising stand columns, tent poles and support poles, the top end of the stand column is fixedly disposed with a top base, a slide base is slidably connected to the stand column to slide up and down along the stand column, the first end of the tent pole is pivoted joint to the top base, the first end of the stand column is pivoted joint to the slide base, the second end of the support pole is pivoted joint to the tent pole; the stand column, the slide base, the tent pole and the support pole form a linkage mechanism, the slide base slides up and down along the stand column to drive the tent rack to unfold and fold; wherein the roof pole is movably connected to the linkage mechanism, the tent rack is unfolded or folded to drive the roof poles to fold or unfold, when the tent rack is unfolded, the roof poles stretch out of the stand columns.

In another preferred embodiment, the first end of the roof pole is movably connected to the support pole, the tent rack is disposed with slide ways, the second end of the roof pole is movably connected to the slide way in stretching and retracting way to drive the roof pole to unfold and fold.

In another preferred embodiment, the first end of the roof pole is pivoted joint to the support pole.

In another preferred embodiment, a connecting base is slidably connected to the support pole, the first end of the roof pole is pivoted joint to the connecting base.

In another preferred embodiment, the center of the support pole is fixedly disposed with a limit protruding, the connecting base slides between the slide base and the limit protruding, when the roof poles are unfolded, the connecting base withstands the limit protruding.

In another preferred embodiment, the tent pole, the top base or the stand column is pivoted joint to a slide element, the slide way is disposed to the slide element, the roof pole is coupled to and slidably connected to the slide way.

In another preferred embodiment, the slide way is disposed to the top base.

In another preferred embodiment, the top portion of the stand column or the tent pole is fixedly disposed with a slide element, the slide way is disposed to the slide element.

In another preferred embodiment, the roof pole is disposed with a first straight section and a second straight section, the first straight section is fixedly connected to the second straight section, the end of the first straight section is the first end of the roof pole, the end of the second straight section is the second end of the roof pole, the second straight section is movably connected to the slide way, the intersection angle of the first straight section and the second straight section is in a range of 90~170.

In another preferred embodiment, the intersection of the first straight section and the second straight section is corresponding to the slide way when the roof poles are unfolded.

A second technical proposal of the present invention to solve the technical problem is that:

A collapsible tent rack, comprising a tent rack and roof poles, the tent rack comprises at least three stand columns and a tent top, a top base is fixedly connected to the top end of the stand columns, a slide base is slidably connected to the stand column to slide up and down along the stand column, the tent top comprises a center base and at least three tent pole sets, the at least three tent pole sets are respectively pivoted joint to the top base of the at least three stand columns and the center base, each tent pole set comprises a first tent pole with one end pivoted joint to the top base of the stand column and a second tent pole with one end pivoted joint to the center base, the other end of the first tent pole is pivoted joint to the other end of the second tent pole, a support pole is pivoted joint between the first tent pole and the slide base, so that the stand column, the slide base, the first tent pole and the support pole form a linkage mechanism, the slide base slides up and down along the stand column to drive the tent rack to unfold and fold; wherein the roof poles are movably connected to the linkage mechanism, the tent rack is unfolded and folded to drive the roof poles to unfold and fold, when the tent rack is unfolded, the roof poles stretch out of the stand columns.

A third technical proposal of the present invention to solve the technical problem is that:

A collapsible tent rack, comprising at least three stand columns and at least a central pole, each stand column is disposed with a top base fixedly connected to the top end and a slide base that is slidably connected to the stand column, the central pole is disposed with a base fixedly connected to the bottom end and a moving base slidably connected to the central pole, the top base and the slide base of two adjacent stand columns are disposed with a folding rack therebetween; the folding rack comprises at least two first scissor type racks that are series connected and pivoted, at least two pivot positions of each folding rack, the base and the moving base of the central pole are disposed with at least one second scissor type rack, so that the stand column can be close to the central pole to fold or be away from the central pole to unfold; at least one stand column is disposed with a roof rack, the roof rack comprises a tent pole, a support pole and a roof pole, one end of the tent pole is pivoted joint to the top base of the stand column, one end of the support pole is pivoted joint to the slide base of the stand column, the other end of the support pole is pivoted joint to the tent pole, so that the tent pole, the support pole, the stand column and the slide base form a linkage mechanism, the roof pole is movably connected to the linkage mechanism and when the awning rack is unfolded, the roof tent stretches out of the stand column.

Compared to the existing technology, the technical proposal of the present invention has advantages as follows:

1. The roof poles are movably connected to the linkage mechanism, the tent rack, when unfolded or folded, drives the roof pole to unfold or fold, when the tent rack is unfolded, the roof pole stretches out of the stand column, on one hand, the tent rack, when unfolded or folded, drives the roof pole to unfold or fold, it realizes the unfolding and folding, making the unfolding or folding convenient and quick, one the other hand, it enhances the support strength of the tent top of the tent rack.

2. The first end of the roof pole is pivoted joint to the support pole, the tent rack is disposed with slide ways, the second end of the roof pole is movably connected to the slide way in stretching way and retracting way to drive the roof pole to unfold and fold, the tent pole, when stretching out or retract back, can rotate about its first end, the structure is simple, the assembly is convenient, and it costs low, the roof pole are connected smoothly in sliding way, thus preventing from getting stuck.

3. A connecting base is slidably connected to the support pole, the first end of the roof pole is pivoted joint to the connecting base, the tent rack is disposed with a slide way, the second end of the roof pole is movably connected to the slide way in stretching and retracting way to drive the roof pole to unfold and fold, the roof pole is slidably connected smoothly, thus preventing from getting stuck, the folded tent rack occupies small space, the roof pole can be made longer, the size of the roof can be made larger, the structure is stable and simple, it is easy to manufacture, and it also costs low.

4. A slide element is pivoted joint to the roof pole or the top base or the stand column, or the slide element is fixedly connected to the top portion of the stand column or the roof pole, the slide way is disposed to the slide element, or the slide way is disposed to the top base, the structure is simple with less components, it occupies small space, and it costs low, the roof pole is connected slidably and smoothly, thus preventing from getting stuck.

5. The roof pole has a first straight section and a second straight section, the intersection angle of the first straight section and the second straight section is 90~170, so that it ensures that the roof pole can slide and move, and it also makes the roof pole coupled to the roof pole when unfolded.

6. The intersection of the first straight section and the second straight section is corresponding to the slide way when the roof pole is unfolded, the supporting is table, flexible and stable, no positioning mechanism is needed between the roof pole and the slide way.

7. The roof pole is movably connected to the linkage mechanism, and it stretches out of the stand column when the awning rack is unfolded, it thus increases the roof area, in other words, comparing to a top stable awning with same roof area, the present invention significantly decreases the cost, it changes point supportings to line supporting, thus enhancing the stability of the tent cloth, stretching the service life of the tent cloth and enhancing the support strength and stability of the awning rack.

BRIEF DESCRIPTION OF THE DRAWINGS

The present invention will be further described with the drawings and the embodiments.

DETAILED DESCRIPTION OF THE EMBODIMENTS

The First Embodiment

Figure 1:
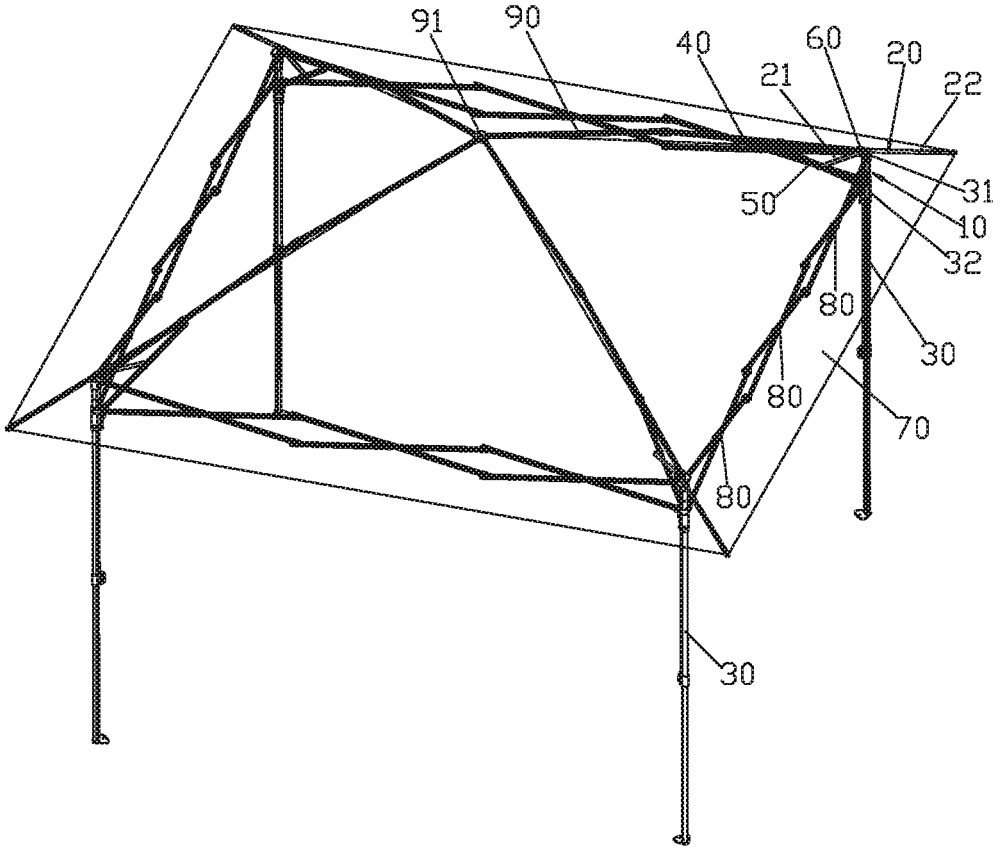
FIG. 1 illustrates a schematic diagram of a tent of a first embodiment in unfolded state.

Referring to FIGS. 4~7, a roof rack 10 of a collapsible tent comprises a tent rack and roof poles 20.

The tent rack comprises stand columns 30, tent poles 40 and support poles 50, the top end of the stand column 30 is fixedly disposed with a top base 31, the stand column 30 is slidably disposed with a slide base 30 sliding up and down along the stand column 30; a lock position is disposed between the slide base 32 and the stand column 30, the lock position makes the slide base 32 kept in a position so that the tent rack keeps in unfolded state, if the lock position is released, the slide base 32 can slide up and down along the stand column. The first end of the tent pole 40 is pivoted joint to the top base 31, the first end of the support pole 50 is pivoted joint to the slide base 32, the second end of the support pole 50 is pivoted joint to the central portion of the tent pole 40, the central portion means any position between the two ends, preferred the position of ¼~¾ or the position of ⅓~⅔. The slide base 32 slides up and down along the stand column to drive the tent rack to unfold and fold, the connecting method and the structure of the stand columns, the tent poles and the support poles can be applied with the existing known technology, the stand column, the slide base, the tent pole and the support pole form a folding and unfolding linkage mechanism.

The tent rack is disposed with slide ways 60. The first end of the roof pole 20 is pivoted joint to the central portion of the support pole 50, the central portion means any position between the two ends, preferred the position of ¼~¾ or ⅓~⅔. the roof pole 20 can move with respect to the slide way 60 to make the second end of the roof pole 20 stretched out of the slide way 60 or retract to the slide way 60, as the first end of the roof pole 20 is pivoted joint to the support pole 50, when the second end of the roof pole 20 stretches out of the slide way 60 or retracts back to the slide way 60, it can rotate about its first end, when the tent rack is unfolded or folded, the second end of the roof pole 20 stretches out of the slide way 60 or retracts back to the slide way 60 to make the roof poles 20 unfolded or folded. When the roof poles 20 are unfolded, the external edge of the tent cloth 70 of the tent is supported on the portion of the roof pole 20 that is stretched out of the slide way.

In this embodiment, the slide way 60 is disposed in the top base 31. The slide way 60 comprises an arc groove 61 with an upward opening and an arc section 62 with a downward opening, two opening ends of the arc groove 61 are extending backwardly to be protruding ears 63, two opening ends of the arc section 62 are respectively fixedly connected to the two protruding ears 63, so that when the second end of the roof pole 20 stretches out of the slide way 60 or retracts back to the slide way 60, the roof pole 20 can rotate about its first end. Preferred, the length of the arc section 62 is shorter than that of the arc groove 61. Actually, this embodiment is not limited to above mentioned technology, the skilled person can apply with other structures, for example: the slide way 60 is hollow with the hole being a conical groove; in another case, the slide way 60 is hollow with the hole being a cylindrical hole, the inner diameter is larger than the outer diameter of the roof pole; in another case, the arc section 62 is fixedly connected to the portion of the slide way near to the rear end. In this embodiment, the slide way 60 is disposed in the top base 31, but not limited to this, as needed, the slide way can be further disposed with slide element, the slide element is fixedly connected to the portion of the tent pole near to the first end or the portion of the stand column near to the top end.

The roof pole 20 is disposed with a first straight section 21 and a second straight section 22, the first straight section 21 is fixedly connected to the second straight section 22, the end of the first straight section 21 is the first end of the roof pole 20, the end of the second straight section 21 is the second end of the roof pole 20, the second straight section 22 is movably connected to the slide way 60, the intersection of the first straight section 21 and the second straight section 22 is 90~170, preferred 120~160 or 140~160, on one hand, it ensures the roof pole can slide and move relatively, so that it is coupled to the tent pole when the roof pole is unfolded, the coupling means that the intersection of the roof pole and the tent pole is 120~200, preferred 175~185; on the other hand, it occupies smaller space when folded.

In another preferred embodiment, the intersection of the first straight section 21 and the section straight section 22 is corresponding to the slide way 60 when the roof pole 20 is unfolded, the corresponding means that the intersection is disposed in the slide way 60, that means the movement is positioned, the support is stable, flexible and reliable, no positioning mechanism is needed between the roof pole and the slide way.

In another preferred embodiment, the support pole is preferred pivoted joint to the tent pole by a pivot base, the roof pole is pivoted joint to the support pole by a pivot base.

Figure 2:
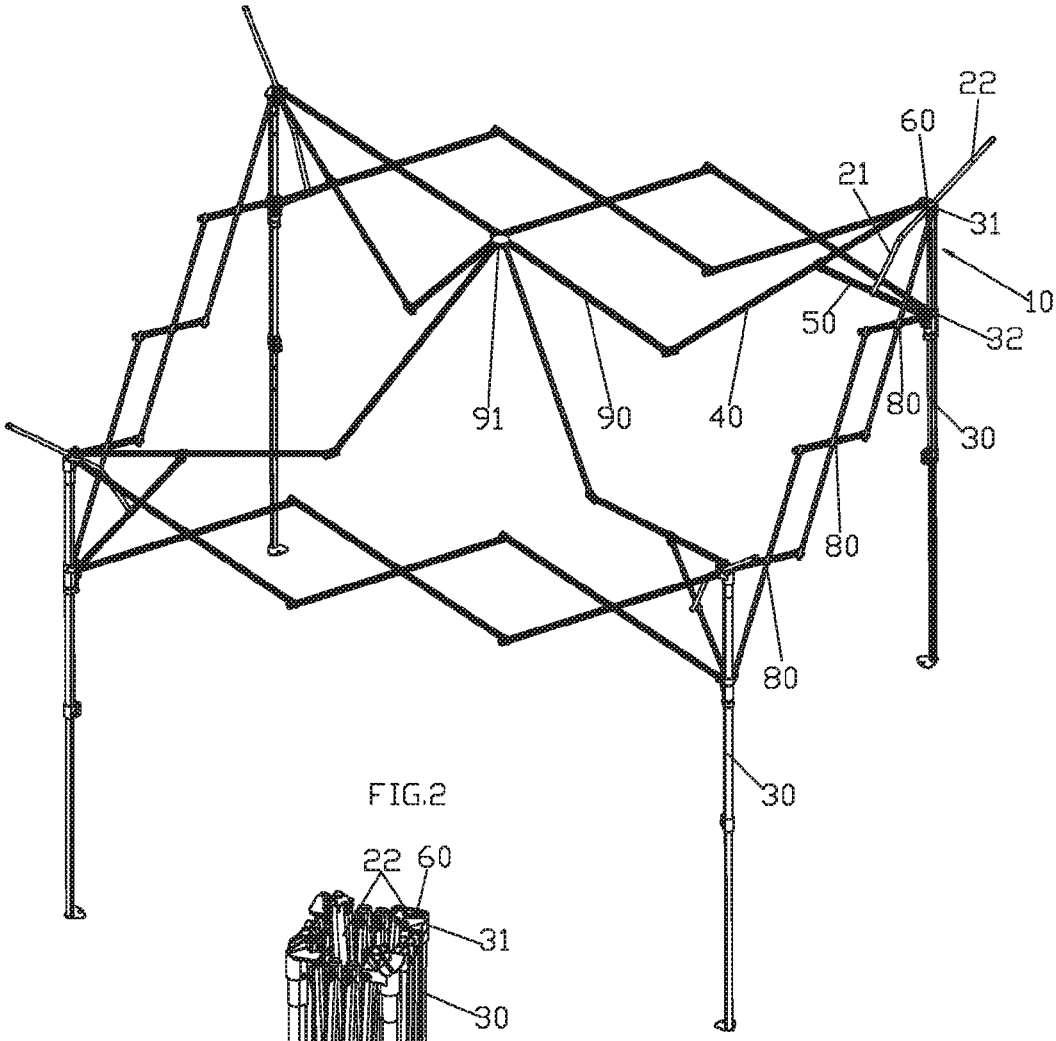
FIG. 2 illustrates a schematic diagram of the tent rack of the first embodiment in semi-folded state.
Figure 3:
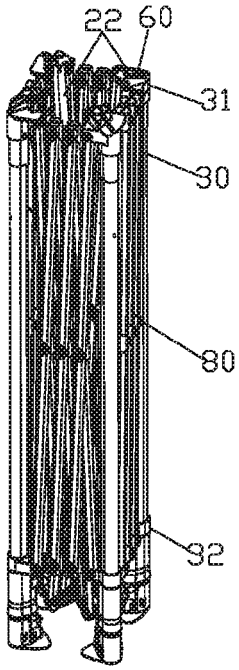
FIG. 3 illustrates a schematic diagram of the tent rack of the first embodiment in folded state.
Figure 4:
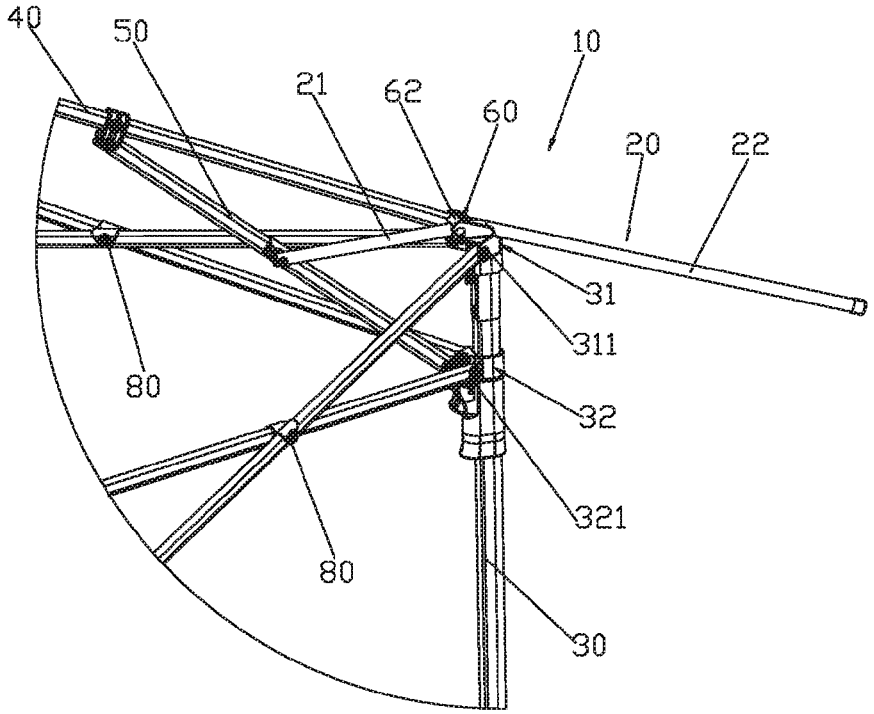
FIG. 4 illustrates a schematic diagram of partial portion of the tent (the roof rack) of the first embodiment in unfolded state.
Figure 5:
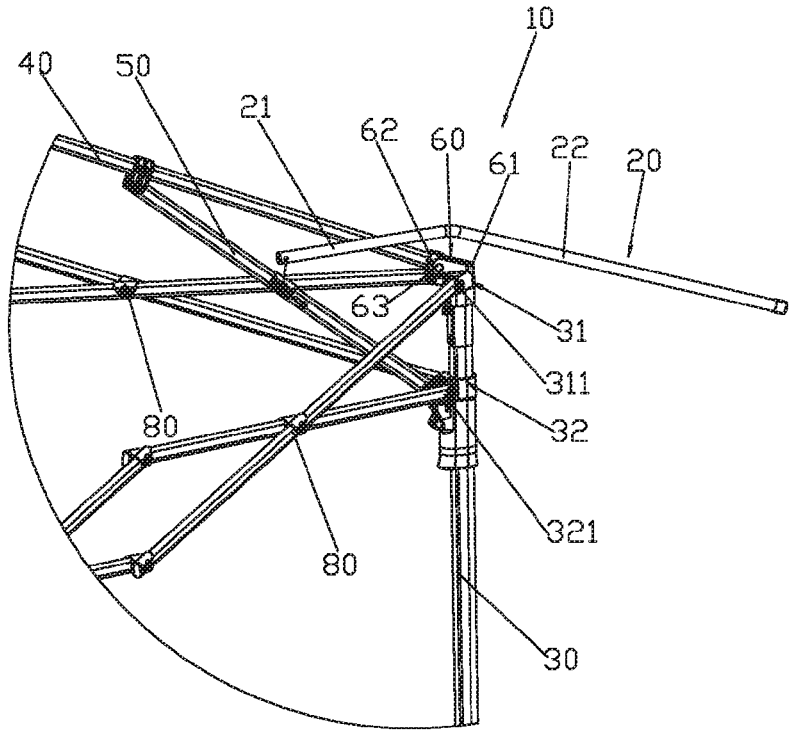
FIG. 5 illustrates an exploded and schematic diagram of a roof rack of the tent of the first embodiment.
Figure 6:
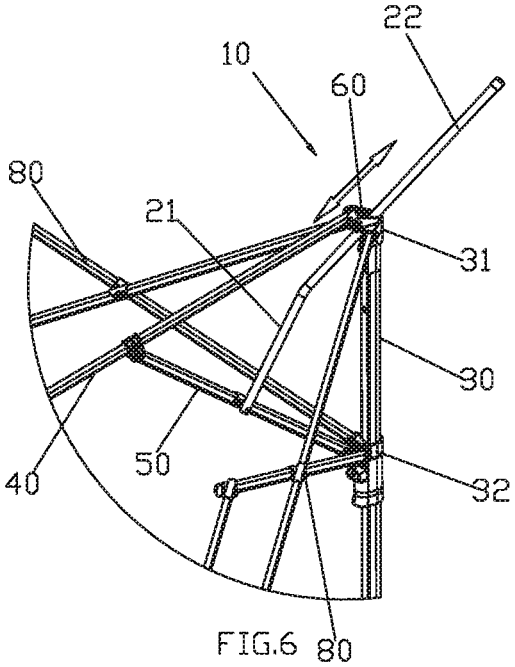
FIG. 6 illustrates a schematic diagram of the roof rack of the tent of the first embodiment in semi-folded state.
Figure 7:
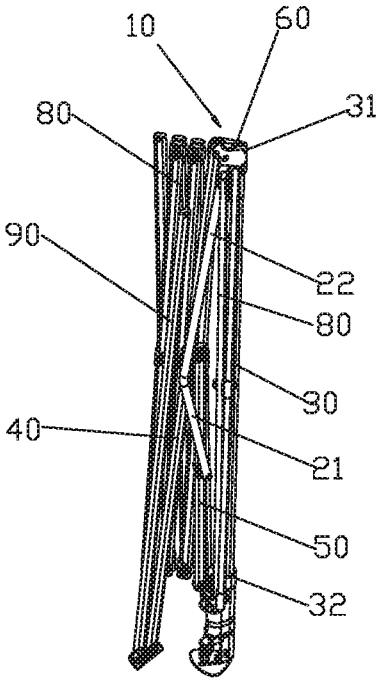
FIG. 7 illustrates a schematic diagram of the roof rack of the tent of the first embodiment in folded state.
Figure 8:
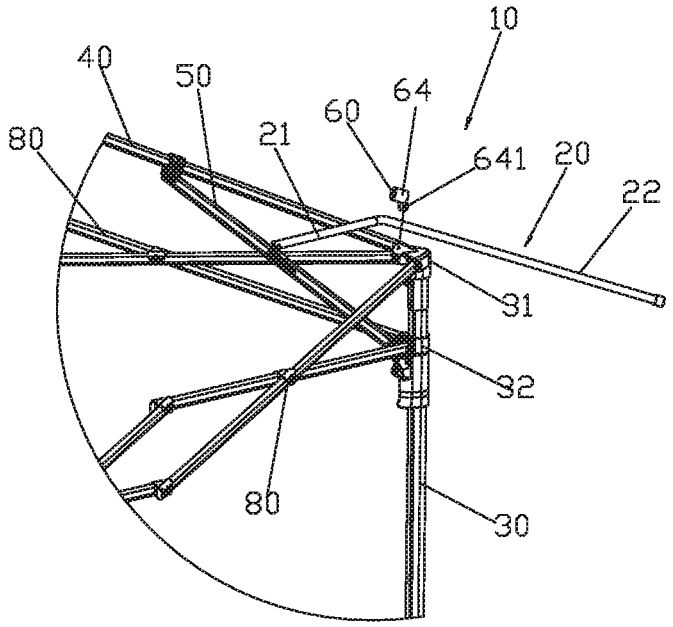
FIG. 8 illustrates a schematic diagram of a roof rack of a second embodiment in unfolded state.
Figure 9:
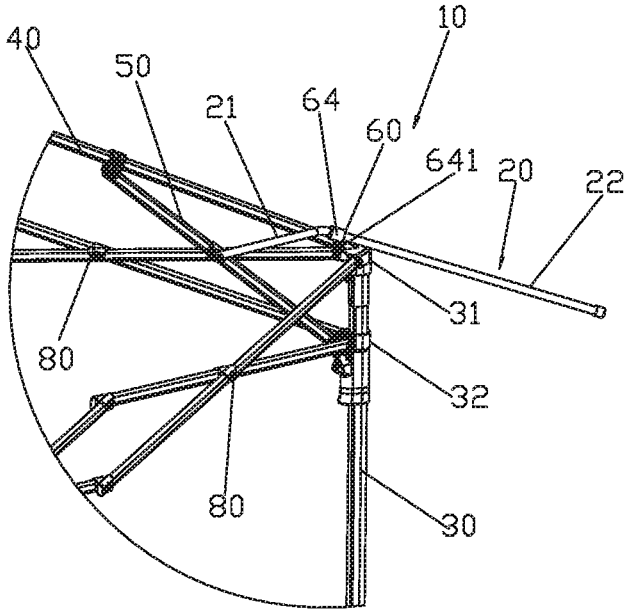
FIG. 9 illustrates an exploded and schematic diagram of the roof rack of the tent of the second embodiment.
Figure 10:
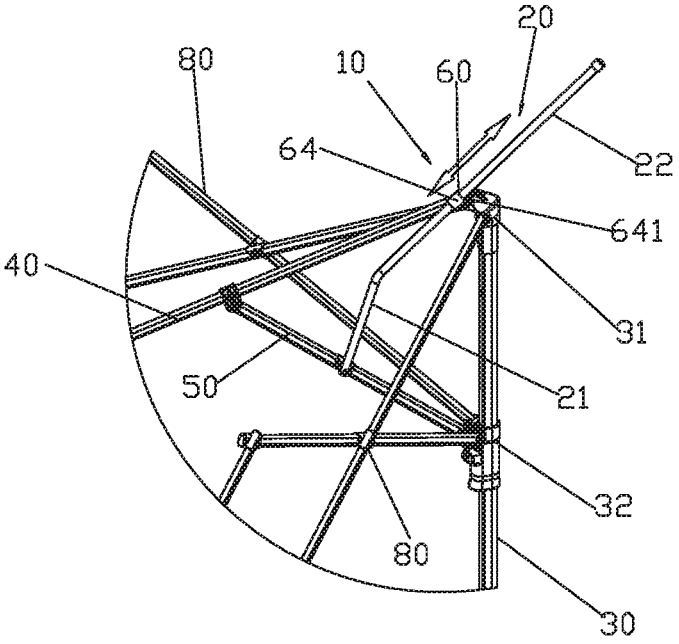
FIG. 10 illustrates a schematic diagram of the roof rack of the second embodiment in semi-folded state.
Figure 11:
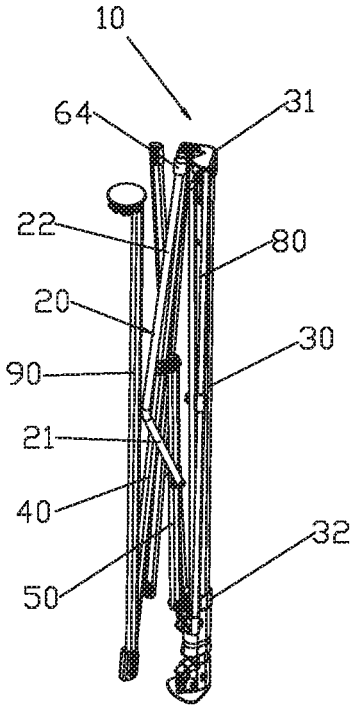
FIG. 11 illustrates a schematic diagram of the roof rack of the second embodiment in folded state.
Figure 12:
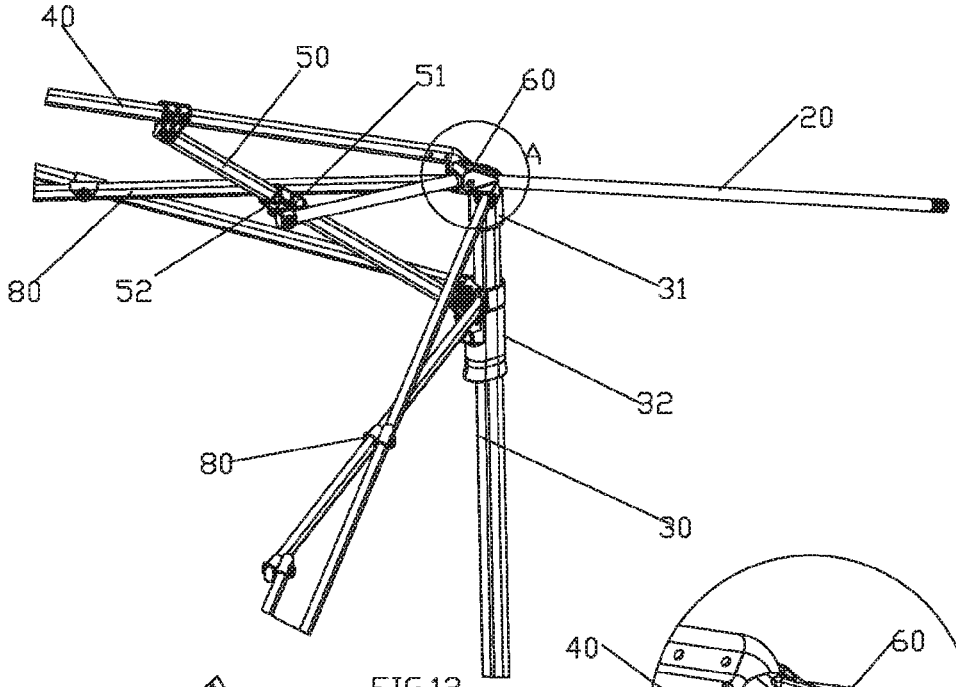
FIG. 12 illustrates a schematic diagram of partial portion of a tent (the roof rack) of a third embodiment in unfolded state.
Figure 13:
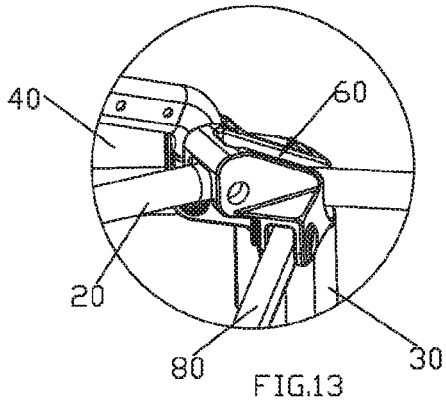
FIG. 13 illustrates an enlargement diagram of A in FIG. 12.
Figure 14:
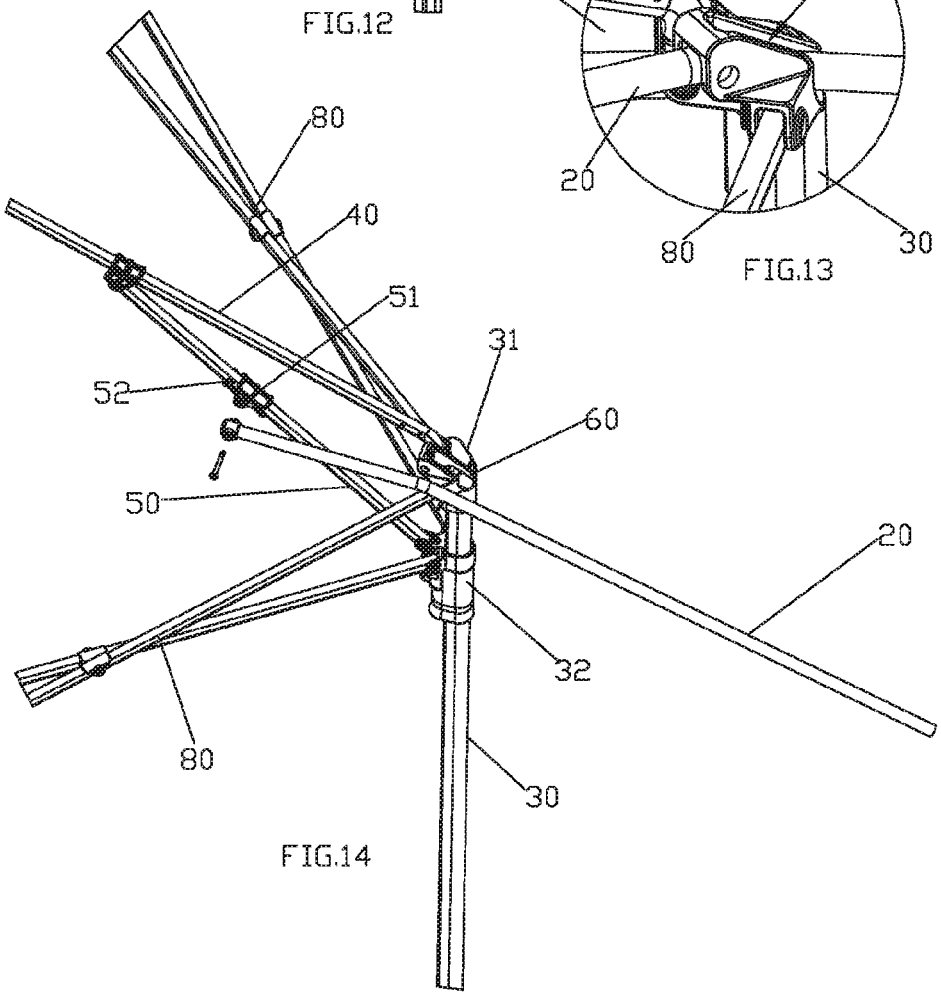
FIG. 14 illustrates an exploded and schematic diagram of the roof rack of the tent of the third embodiment.
Figure 15:
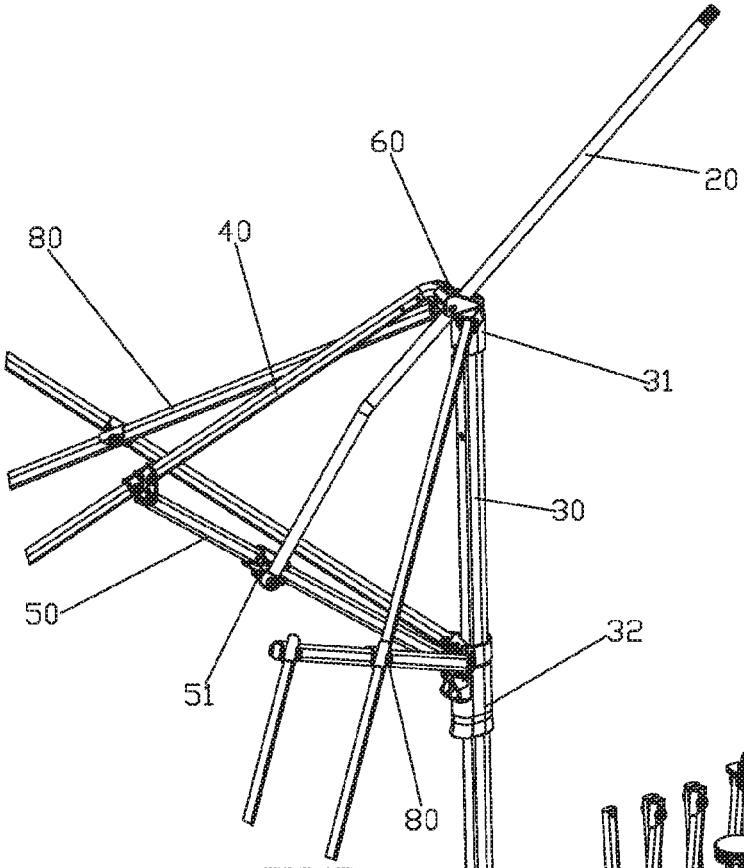
FIG. 15 illustrates a schematic diagram of the roof rack of the tent of the third embodiment in semi-folded state.
Figure 16:
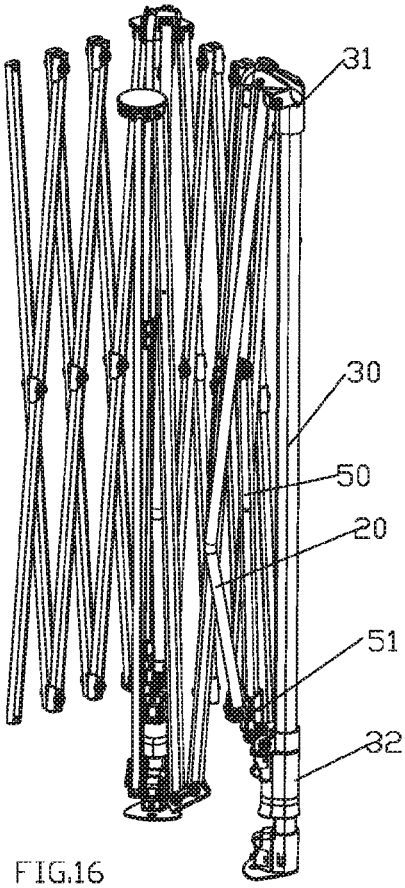
FIG. 16 illustrates a schematic diagram of the roof rack of the third embodiment in folded state.
Figure 17:
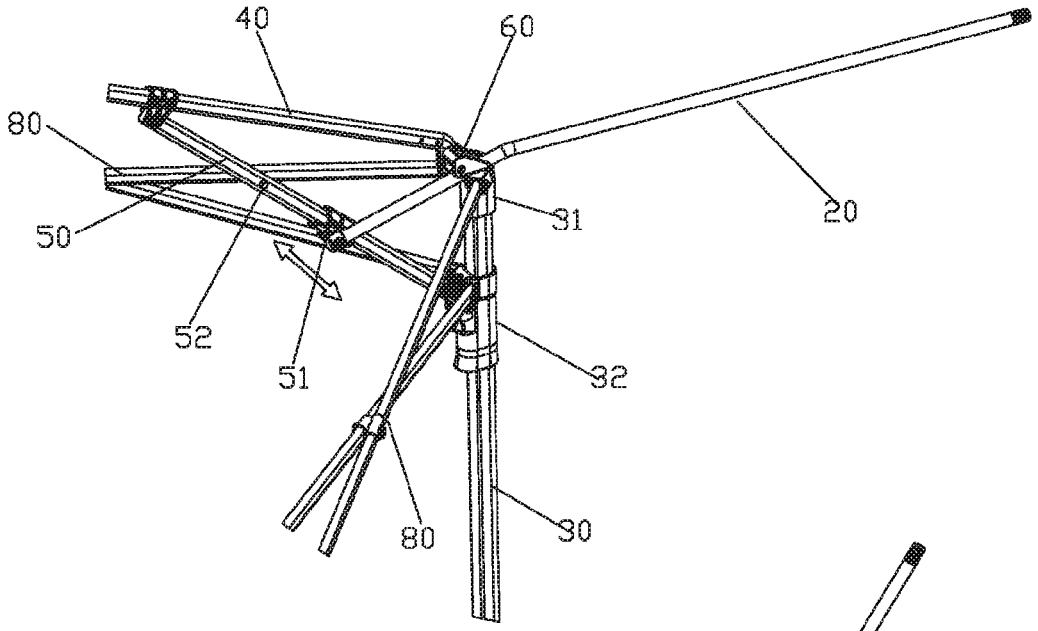
FIG. 17 illustrates a first schematic diagram of the connecting base sliding with respect to the support pole of the roof rack of the third embodiment.
Figure 18:
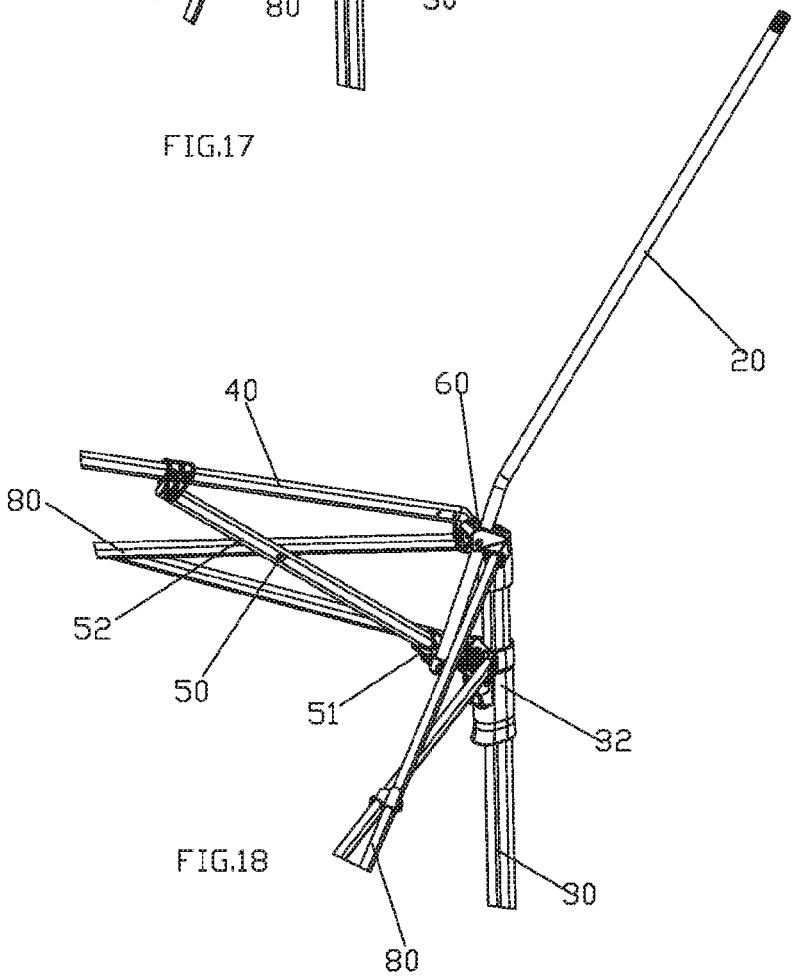
FIG. 18 illustrates a second schematic diagram of the connecting base sliding with respect to the support pole of the roof rack of the third embodiment.

Referring to FIG. 1, FIG. 2 and FIG. 3, an application of the present invention is disclosed that the collapsible tent comprises tent rack poles and a tent cloth 70 covering on the tent rack poles. In this embodiment, the tent rack poles comprise above mentioned mechanism, and: in these stand columns 30, a folding rack is pivoted joint between two adjacent stand columns 30, the folding rack comprises at least two scissor type linkage pole sets 80 that are series connected and pivoted, the series connecting and pivoting mean that in two adjacent linkage pole sets: the upper ends of the adjacent linkage pole sets are pivoted joint together, the low ends of the adjacent linkage pole sets are pivoted joint together, the folding rack has four second ends, the four second ends are respectively pivoted joint to the top base 31 and the slide base 32 of the two adjacent stand columns 30; for convenient pivoting, the top base 31 and the slide base 32 are respectively disposed with pivot ears 311, 321 to be pivoted joint to the second ends of the folding rack. Each tent pole 40 is named the first tent pole, the other end of the first tent pole is pivoted joint to a second tent pole 90, the second ends of the second tent poles 90 are arranged annularly and pivoted joint to a central base 91. The structure of the tent rack poles can be referred to existing tent rack poles.

The Second Embodiment

Referring to FIGS. 8-11, the difference from the first embodiment is that: the roof rack 10 further comprises a slide element 64, the slide element 64 is pivoted joint to the top base 31, the slide way 60 is disposed to the slide element 64, the second straight section 22 of the roof pole 20 is coupled to the slide way 60 and slidably connected to the slide way 60, the relative movement of the slid way and the second straight section forms a translation structure. The intersection of the first straight section and the second straight section is corresponding to the slide way when the roof pole is unfolded, the corresponding means that the intersection rightly abuts against the slide element, the intersection is rightly near to the entrance of the slide way 60. In this embodiment, the slide way is pivoted joint to the top base, but not limited to this, as needed, it can also be pivoted joint to the portion of the stand column near to the top end or pivoted joint to the portion of the tent pole near to the first end.

In another preferred embodiment, a pivot protruding ear 641 is disposed to the slide element 64, the pivot protruding ear is pivoted joint to the tent pole.

The Third Embodiment

Referring to FIGS. 12-18, the difference from the first embodiment is that: the support pole 50 is slidably connected with a connecting base 51, the first end of the roof pole 20 is pivoted joint to the connecting base 51, the second end of the roof pole 20 is movably connected to the slide way 60 in stretching and retracting way to drive the roof pole 20 to unfold and fold. The slide way 32 slides up and down along the stand column 30 to drive the tent rack to unfold and fold, the tent rack, when unfolding or folding, drives the roof pole to stretch out or retract back.

The central portion of the support pole 50 is fixedly disposed with a limit protruding 52, the connecting base 51 slides between the slide way 32 and the limit protruding 52, when the roof pole 20 is unfolded, the connecting base 52 abuts against the limit protruding 52. Preferred, the lower portion of the support pole 50 is further disposed with a second limit protruding, the connecting base slides between the two limit protrudings.

The Fourth Embodiment

Figure 19:
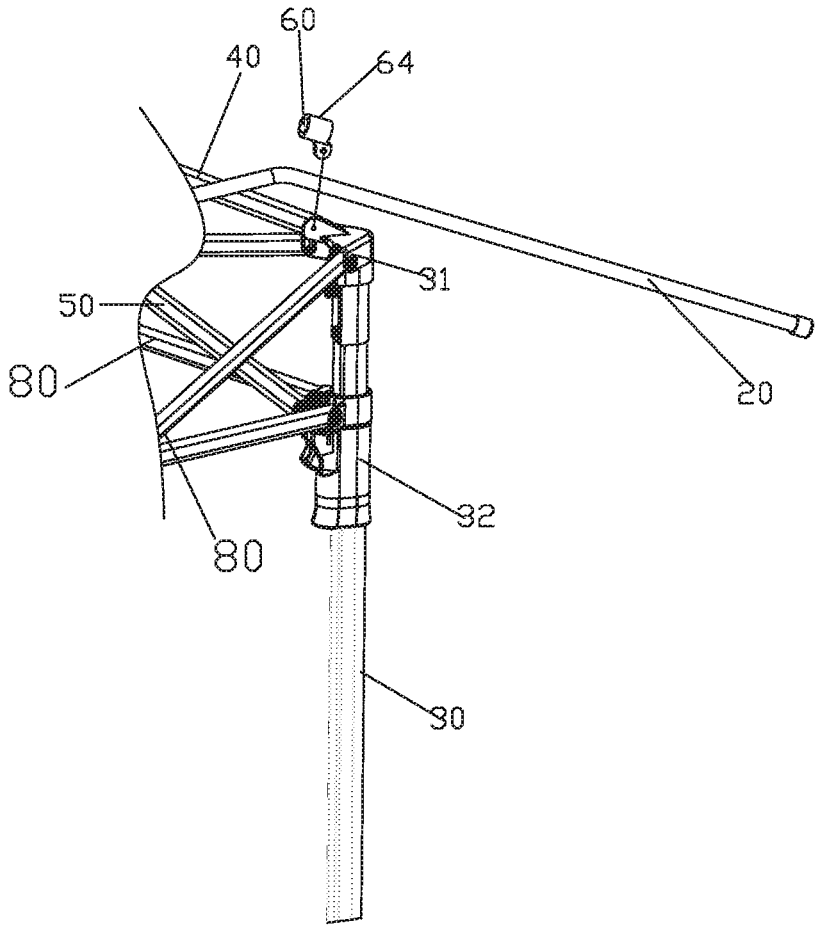
FIG. 19 illustrates a schematic diagram of a tent rack of a fourth embodiment.
Figure 20:
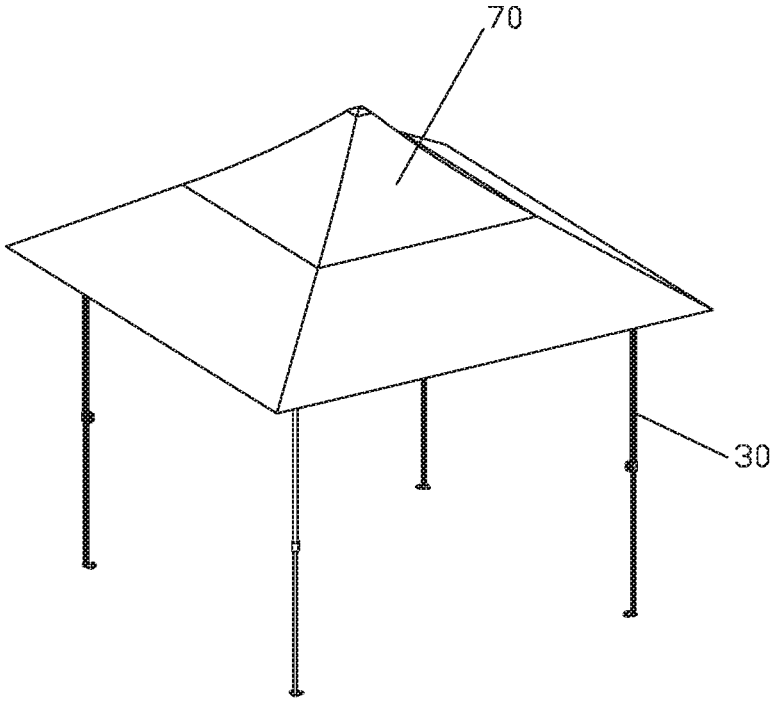
FIG. 20 illustrates a schematic diagram of a top awning rack of a fifth embodiment.
Figure 21:
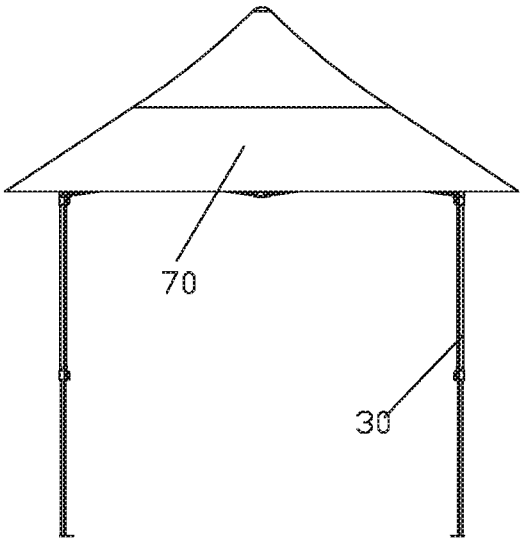
FIG. 21 illustrates a front view of the top awning rack of the fifth embodiment.
Figure 22:
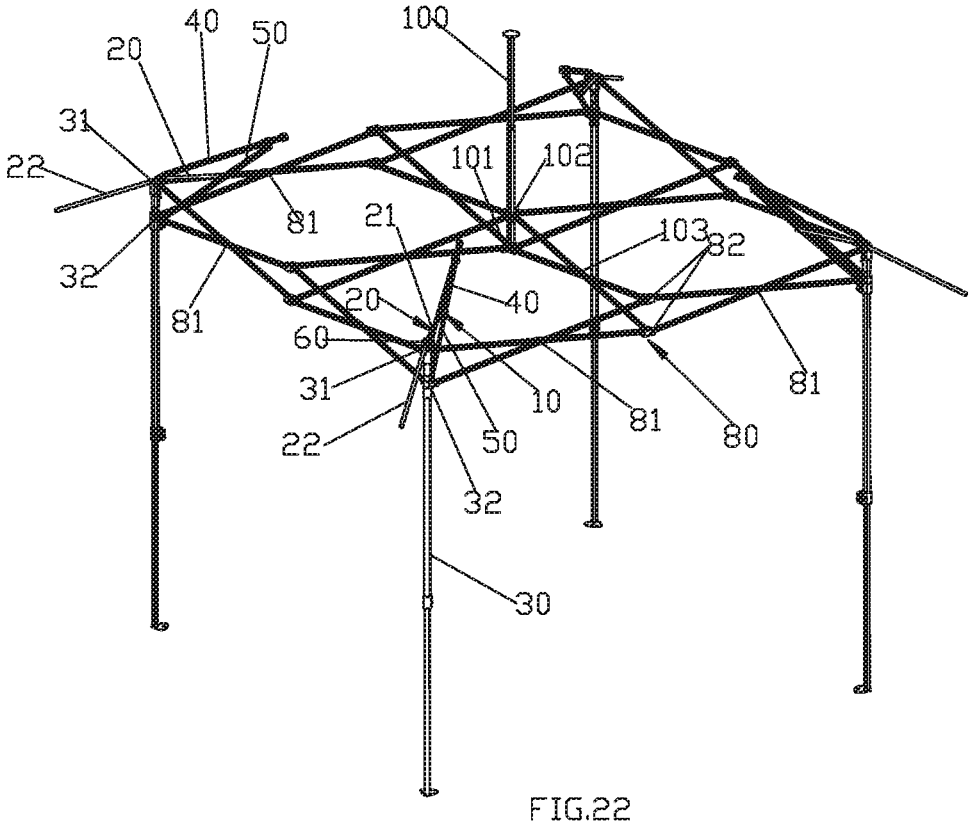
FIG. 22 illustrates a schematic diagram of the top awning rack of the fifth embodiment in unfolded state.
Figure 23:
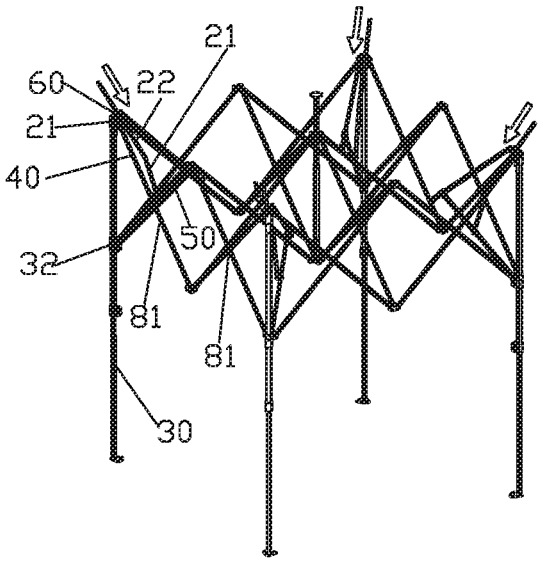
FIG. 23 illustrates a schematic diagram of the top awning rack of the fifth embodiment in semi-folded state.
Figure 24:
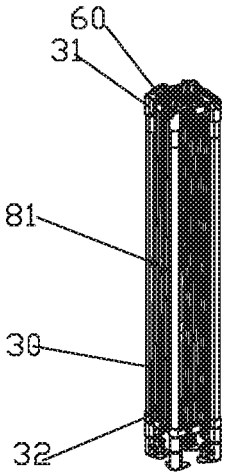
FIG. 24 illustrates a schematic diagram of the top awning rack of the fifth embodiment in folded state.

Referring to FIG. 19, the difference from the third embodiment is that: a slide element 64 is pivoted joint to the top base, the slide element 64 is disposed with above mentioned throughout slide way 60.

The Fifth Embodiment

Referring to FIGS. 20~24, a top awning with a roof rack comprises a top awning rack and a tent cloth 70. The top awning rack comprises at least three stand columns 30 and at least a central pole 100. As needed, the stand column 30 is a flexible stand column, the at least three stand columns 30 are arranged at the corners of the polygon that surrounds the central pole 100. In this embodiment, it takes four stand columns for example, but not limited to this, as needed, three stand columns, six stand columns and eight stand columns are available. In this embodiment, taking one central pole 100 for example, but not limited to this, as needed, two central poles 100 are available, as mentioned in the second embodiment. Therein, when there is only one central pole 100, a second scissor type rack is disposed between the folding rack and the central pole, when there are two or three central poles 100, the second scissor rack is disposed between each central pole and the two pivot positions of the at least two folding rack of the central pole.

Each stand column 30 is disposed with a top base 31 fixedly connected to the top end and a slide base 32 that is slidably connected, the slide base 32 and the stand column cooperate to make the slide base 32 locked and positioned at the preset height, releasing the lock can make the slide base 32 slide freely. The central pole 100 is disposed with a base set 101 fixedly connected to the bottom end and a slidable moving base 102, the moving base 102 and the central pole 100 cooperate to make the moving base 102 locked and positioned at the preset height, releasing the lock can make the moving base 102 slide freely.

A folding rack 80 is disposed between the top base 31 and the slide base 32 of two adjacent stand columns 30, the adjacency means the adjacency in the rounding direction. The folding rack 80 comprises at least two first scissor type racks 81 that are series connected and pivoted, the first scissor type rack comprises first linkage poles that are pivoted at the central portions, the series connecting and pivoting means that the first scissor type racks are series arranged, the upper ends of the two adjacent first linkage poles are pivoted, the lower ends of the two adjacent first linkage poles are pivoted, as needed, the end portions of the two linkage pole can be directly pivoted or be pivoted to the pivot base 82 to realize the above mentioned pivoting, the position of the pivoted end portions of the first linkage poles or the pivot base are the pivot position, so that the first folding rack 80 can be unfolded and folded, each folding rack 80 has four second ends, the four second ends are pivoted joint to the top base 31 and the slide base 32 of the two adjacent stand columns 30, so that two stand columns can be away or toward to each other. In this embodiment, the folding rack 80 comprises two first scissor type racks, for example, but not limited to this, as needed, three or four first scissor type racks are available. In this embodiment, it takes two first scissor type racks for example, so that it has two pivot positions, if there are three first scissor type racks, it has four pivot positions.

Two pivot positions of each folding rack 80, the base set 101 of the central pole 100 and the moving base 102 have at least a second scissor type racks 103, in this embodiment, it takes one second scissor type rack for example, but not limited to this, it can be applied with two or three second scissor type racks as needed. The four second ends of the second scissor type rack 103 are respectively pivoted joint to the two pivot positions of the folding racks 80, the base 101 and the moving base 102 of the central pole 100, at least two second scissor type racks are series connected and pivoted. If there are three or more first scissor type racks, one central pole can be connected to the two pivot positions at the central position of the folding rack.

With above connection, the stand column 30 can be close to the central pole 100 to fold or be away from the central pole 100 to unfold. The structure can be applied with exiting known technology like the disclosed in U.S. Pat. No. 5,244,001 and CN91105446.4 in the background of the invention.

At least one stand column 30 or the at least three stand columns 30 is disposed with a roof rack 10, preferred, each stand column 30 at the corner of the polygon is disposed with a roof rack 10.

The roof rack 10 comprises a tent pole 40, a support pole 50 and a roof pole 20. one end of the tent pole 40 is pivoted joint to the top base of the stand column 30, one end of the support pole 50 is pivoted joint to the slide base 32 of the stand column 30, the other end of the support pole 50 is pivoted joint to the other end of the tent pole 40, so that the tent pole 40, the support pole 50, the stand column 30 and the slide base form a linkage mechanism, the roof pole 20 is movably connected to the linkage mechanism and it stretches out of the stand column 30 when the awning rack is unfolded, in this embodiment, the top base 31 of the stand column 30 is disposed with a slide way 60, the first end of the roof pole 20 is pivoted joint to the central portion of the support pole 50, the central portion means any position between the two ends, preferred the position of ¼~¾ or the position of ⅓~⅔. As the first end of the roof pole 54 is pivoted joint to the support pole 50, when the second end of the roof pole 54 stretches out of the slide way or retract back to the slide way, the roof pole 54 can rotate about its first end, when the awning rack is unfolded or folded, it drives the second end of the roof pole 54 to stretch out of the slide way or retract back to the slide way thus to drive the roof pole to unfold of fold, that is to say, when the awning rack is unfolded or folded, it drives the roof pole to unfold or fold.

In another preferred embodiment, the roof pole 20 is disposed with a first straight section 21 and a second straight section 22, the first straight section 21 is fixedly connected to the second straight section 22, the end of the first straight section 21 is the first end of the roof pole 20, the end of the second straight section 21 is the second end of the roof pole 20, the second straight section 22 is movably connected to the slide way 60, the intersection of the first straight section 21 and the second straight section 22 is 90~170, preferred 120~160 or 140~160, on one hand, it ensures the roof pole can slide and move relatively, so that it is coupled to the tent pole when the roof pole is unfolded, the coupling means that the intersection of the roof pole and the tent pole is 120~200, preferred 175~185; on the other hand, it occupies smaller space when folded. The intersection of the first straight section 21 and the section straight section 22 is corresponding to the slide way 60 when the roof pole 20 is unfolded, the corresponding means that the intersection is disposed in the slide way 60, that means the movement is positioned, the support is stable, flexible and reliable, no positioning mechanism is needed between the roof pole and the slide way.

The slide way 60 comprises an arc groove with an upward opening and an arc section with an downward opening, preferred, two opening ends of the arc groove are stretched backwardly to be protruding ears, the opening ends of the arc sections are respectively fixedly connected to the two protruding ears, so that when the second end of the roof pole stretches out of the slide way or retracts back to the slide way, the roof pole can rotate about its first end. Preferred, the length of the arc section is shorter than the length of the arc groove. This embodiment is not limited to above structure, the skilled person can apply with other structures, for example, the slide way 60 is hollow with the hole be conical groove; in another case, the slide way 60 is hollow with the hole be cylindrical hole, the inner diameter is larger than the outer diameter of the roof pole; in another case, the arc section 62 is fixedly connected to the portion of the slide way near to the rear end. In this embodiment, the slide way 60 is disposed in the top base 31, but not limited to this, as needed, the slide way can be further disposed with slide element, the slide element is fixedly connected to the portion of the tent pole near to the first end or the portion of the stand column near to the top end.

The center of the tent cloth 70 is supported at the top end of the central pole, the corners are connected to the tent poles and the roof poles, so that it increases the roof area surrounded by the second ends of the roof poles and the stand columns, the tent pole and the roof pole supports the tent cloth, forming a line supporting, it lengthens the service life of the tent cloth.

The Sixth Embodiment

Figure 25:
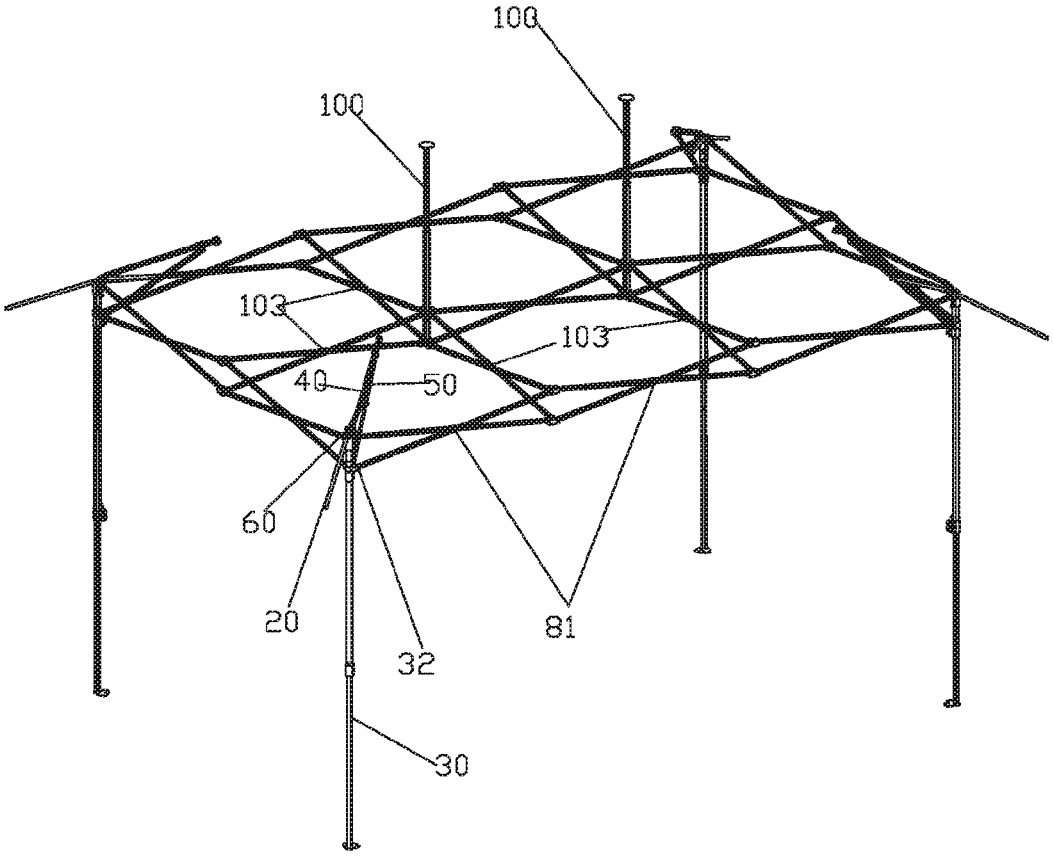
FIG. 25 illustrates a schematic diagram of a top awning rack of a sixth embodiment in unfolded state.

Referring to FIG. 25, the difference from the fifth embodiment is that: the top awning rack comprises two central poles 100, at least a third scissor rack 60 is pivoted between the second slide base and the top base of the two central poles 100, as needed, no third scissor type rack can be configured; in the four folding rack, two opposite folding racks 80 comprises three first scissor type rack 81 that are series connected and pivoted, the folding rack 80 has four pivot positions, a second scissor rack is disposed between one central pole and two pivot positions, a second scissor type rack is disposed between the other central pole and the other two pivot positions; the other two opposite folding rack comprises two first scissor type racks 81 that are series connected and pivoted, the folding rack 80 has two pivot positions, the two pivot positions and the two central pole are disposed respectively with a second scissor type rack therebetween. The downward projection of the whole top awning rack is a rectangle with its length-width ratio 3:2.

The Seventh Embodiment

The difference of the seventh embodiment from the fifth embodiment is that: the support pole is slidably disposed with a connecting base, the first end of the roof pole is pivoted joint to the connecting base.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A roof rack of a collapsible tent, comprising a tent rack and roof poles, the tent rack comprises stand columns, tent poles and support poles, a top end of a stand column is fixedly disposed with a top base, a slide base is slidably connected to the stand column to slide up and down along the stand column, a first end of the tent pole is pivotably joined to the top base, a first end of a support pole is pivotably joined to the slide base, a second end of the support pole is pivotably joined to the tent pole; the stand column, the slide base, the tent pole and the support pole form a linkage mechanism, the slide base slides up and down along the stand column to drive the tent rack to unfold and fold;

wherein the roof pole is movably connected to the linkage mechanism, the tent rack is unfolded or folded to drive the roof poles to fold or unfold, when the tent rack is unfolded, the roof poles stretch out of the stand columns; and wherein the roof pole is disposed with a first straight section and a second straight section, the first straight section is fixedly connected to the second straight section, an end of the first straight section is the first end of the roof pole, an end of the second straight section is the second end of the roof pole, the second straight section is movably connected to the slide way, and an intersection angle of the first straight section and the second straight section is in a range of 90 degrees to 170 degrees.

2. The roof rack of a collapsible tent according to claim 1, wherein a first end of a roof pole is movably connected to the support pole, the tent rack is disposed with a slide way, a second end of the roof pole is movably connected to the slide way in a stretching and retracting way to drive the roof pole to unfold and fold.

3. The roof rack of a collapsible tent according to claim 2, wherein the first end of the roof pole is pivotably joined to the support pole.

4. The roof rack of a collapsible tent according to claim 3, wherein the slide way is coupled to the top base.

5. The roof rack of a collapsible tent according to claim 3, wherein a top portion of the stand column or the tent pole is fixedly disposed with a slide element, and the slide way is an opening in the slide element.

6. The roof rack of a collapsible tent according to claim 1, wherein the intersection angle of the first straight section and the second straight section corresponds to the slide way when the roof poles are unfolded.

* * * * *